United States Patent [19]

Nyström

[11] 4,073,316

[45] Feb. 14, 1978

[54] FLEXIBLE FLOW DIVERTER

[75] Inventor: K. Sture Nyström, Solna, Sweden

[73] Assignee: Skega Aktiebolag, Ersmark, Sweden

[21] Appl. No.: 733,928

[22] Filed: Oct. 19, 1976

Related U.S. Application Data

[63] Continuation of Ser. No. 553,644, Feb. 27, 1975, abandoned, which is a continuation of Ser. No. 358,354, May 8, 1973, abandoned.

[30] Foreign Application Priority Data

June 12, 1972 Sweden ..... 7717/72

[51] Int. Cl.[2] ..... F15C 1/08; F15C 1/14; F15C 1/16

[52] U.S. Cl. ..... 137/829; 137/831; 137/813; 251/342

[58] Field of Search ..... 137/829, 830, 831, 832, 137/836, 607, 609, 610; 251/342; 138/45; 251/9

[56] References Cited

U.S. PATENT DOCUMENTS

| | | | |
|---|---|---|---|
| 2,598,208 | 5/1952 | Bailey | 138/45 |
| 2,954,205 | 9/1960 | Musser | 137/609 |
| 3,075,551 | 1/1963 | Smith et al. | 137/609 |
| 3,102,710 | 9/1963 | Dresden | 251/9 |
| 3,108,613 | 10/1963 | Bochan | 137/609 |
| 3,187,762 | 6/1965 | Norwood | 137/831 |
| 3,266,511 | 8/1966 | Turick | 137/829 |
| 3,276,463 | 10/1966 | Bowles | 137/831 |
| 3,283,766 | 11/1966 | Horton | 137/829 |
| 3,448,769 | 6/1969 | Cornelius | 137/607 |
| 3,509,775 | 5/1970 | Evans | 137/829 |
| 3,540,463 | 11/1970 | Meyer | 137/828 |
| 3,613,708 | 10/1971 | Kampe | 137/829 |
| 3,734,133 | 5/1973 | Little et al. | 137/636 |
| 3,754,576 | 8/1973 | Zetterstrom | 137/829 |

FOREIGN PATENT DOCUMENTS

| | | | |
|---|---|---|---|
| 646,167 | 11/1950 | United Kingdom | 251/9 |

*Primary Examiner*—William R. Cline

*Attorney, Agent, or Firm*—Burns, Doane, Swecker & Mathis

[57] ABSTRACT

A flow device for interaction with a fluid stream to control its direction comprises a conduit system which includes a cavity in communication with an inlet for the stream and at least one outlet for the stream. controllable flexible means co-operative with the cavity are provided for interaction with the stream and function to deflect the stream in one direction or the other from its entering direction as it leaves the cavity. The fluid stream can be selectively directed into one or the other of two separate outlets, or a single outlet can be combined with a vortex arrangement so as to enable one to select the direction of rotation of the stream about the axis of the vortex. In one embodiment of the invention, the controllable flexible means by means of which the stream is made to change its direction or flow is constituted by a flexible diaphragm situated at the branching point of Y-shaped outlets which shifts the fluid flow from the one branch to another; in another embodiment the stem of a Y-shaped arrangement is bent in one direction or the other to effect a shift in the fluid flow from one branch outlet of the Y to the other; in another embodiment, a deflectable vane is situated in the branching point of the Y-shaped arrangement; in still another embodiment, the conduit is provided with an inlet and an outlet separated by a gap established by the inner ends of two mutually opposite fluid stream-deflectable members together with means for imparting a turning movement to at least one of the deflectable members in one direction relative to the other to effect a corresponding change in direction of the fluid flow at the outlet; and according to still another embodiment, the conduit system takes the form of a vortex fluidister having a cylindrical primary flow-through passage and a secondary inlet including a rigid tube entering through the wall of the primary flow-through passage but which can be brought to varying angular positions from an initial position normal to the primary flow-through passage.

8 Claims, 31 Drawing Figures

FIG. 15A
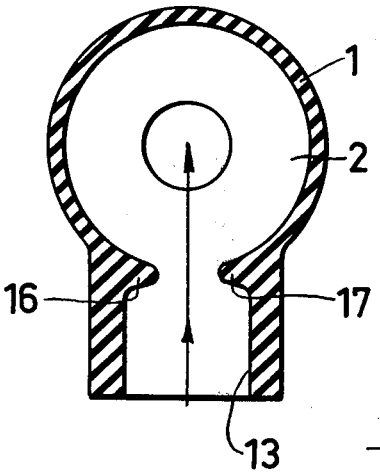
FIG. 15B
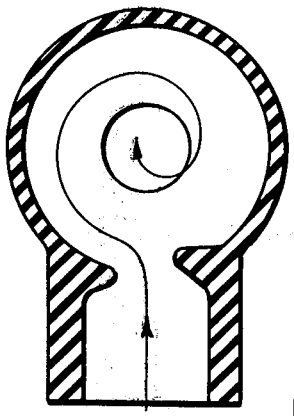
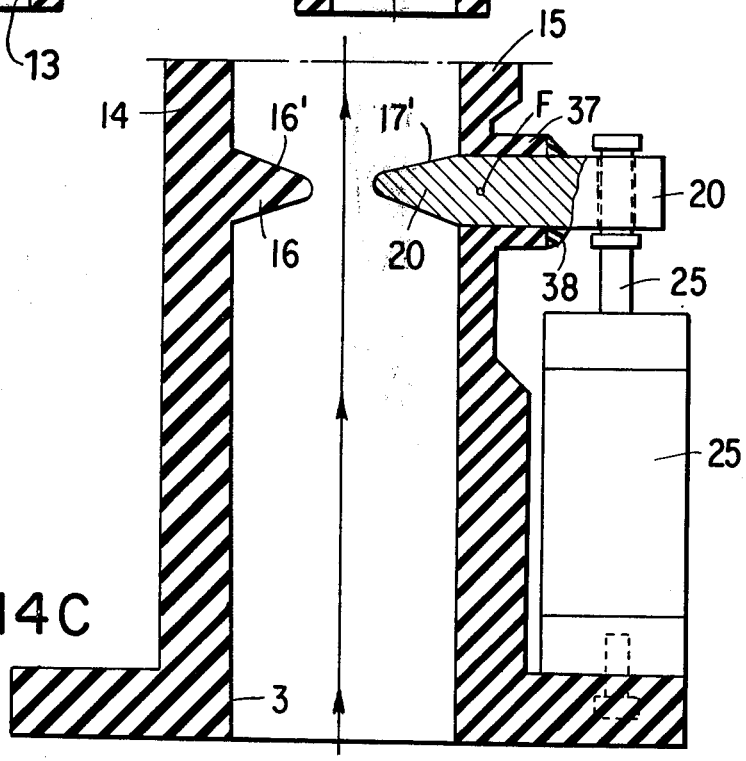
FIG. 14C

FLEXIBLE FLOW DIVERTER

This is a continuation of application Ser. No. 553,644 filed on Feb. 27, 1975 which in turn is a continuation of Ser. No. 358,354 filed May 8, 1973 both now abandoned.

This invention relates to a flow device for the interaction with a fluid stream, the device comprising a conduit system with a cavity with at least one inlet passage and at least one outlet for a fluid stream.

Known fluidistors normally have two opposed control fluid conduits or secondary inlet ports arranged about perpendicularly relative to the inlet direction of the main fluid flow in said cavity, to make possible by the inlet or injection of a control fluid through such port or through either of such opposed ports to bring the main fluid flow to change for example from laminary flow to turbulent flow or from one outlet then being used to another or to a restricted outlet.

Said arrangement, however, has several disadvantages among which could be mentioned the consumption of control fluid and the risk of obstruction of the control fluid ports.

These disadvantages are eliminated by a flow device according to the invention, said flow device comprising flexible means for interaction with a fluid stream entering said cavity such that said fluid stream as in fluidistors is by way of example brought gradually to change its flow characteristics (flow rate) and/or gradually to increase or decrease its flow rate and/or to shift its direction from one outlet then being used to another or to or from a restricted outlet, respectively, said flow device preferably consisting partially or as a whole of a flexible material such as for example rubber.

According to an embodiment of the flow device of the present invention, at least in one of the opposite walls of said cavity there is arranged a control chamber having a wall against said conduit system which wall is deformable by varying the pressure of a control fluid in the chamber to make possible bringing about said change of direction of the fluid stream entering the cavity from said inlet passage by making use of the "Coanda-effect" or "wall effect" which effect per se is well known from the field of fluidistors.

In another embodiment of the flow device according to the invention the inlet passage is arranged to be pivoted or bent relative to said cavity by direct or indirect actuation thereof so that by such actuation the inlet passage is able to bring about said change of direction of the fluid stream entering said cavity from said inlet passage. In such embodiment the housing of the device partly or as a whole advantageously consists of a flexible material such as for example rubber.

In still another embodiment of the invention the flow device is arranged with a directing device for bringing about said change of direction of the fluid stream entering the cavity from said inlet passage, said directing device comprising opposite means for example being wedgelike and protruding inwardly from the walls of said inlet passage or from the walls of the cavity, said means by direct or indirect actuation being mutually turnable or displaceable to make possible bringing about said change of direction of the fluid stream entering said cavity from said inlet passage. Among many fields of application the flow device according to the present invention can be used within the same fields as fluidistors, such as for the control of a fluid stream or as an amplifier or for the measurement or sensing of flow rate, pressure or temperature of a flow stream.

The invention is described in greater detail in the following with reference to the accompanying drawings showing by way of example in a schematical way the above and other embodiments of flow devices according to the invention.

FIG. 14C is a longitudinal section of still another embodiment of the device according to FIG. 12.

Figure 12:
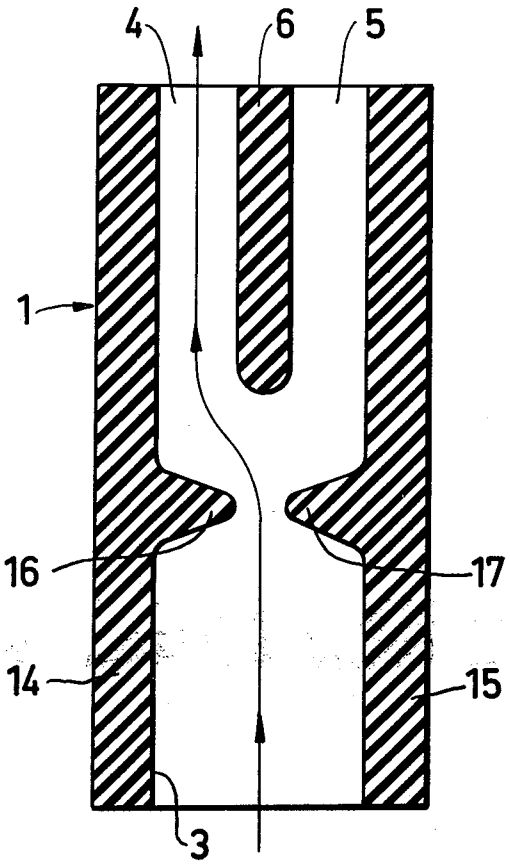

FIG. 15A and FIG. 15B diagrammatically show the arrangement of FIG. 12 in combination with a vortex fluidistor.

Figure 16B:
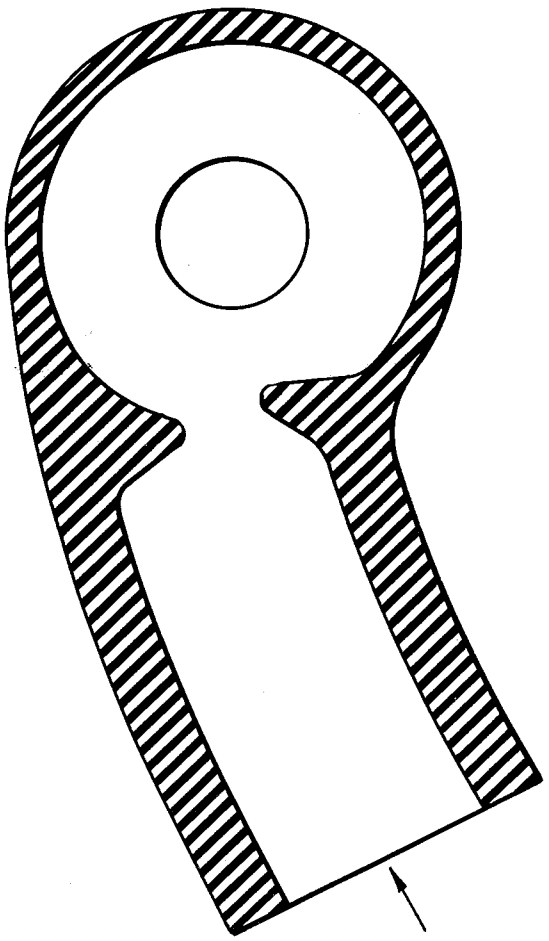
Figure 16A:
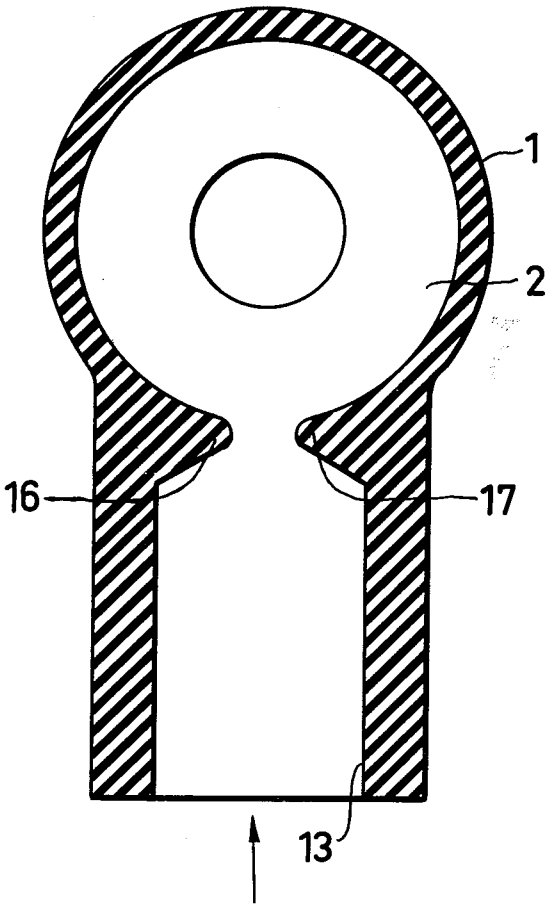

FIGS. 16A and 16B are showing sections of an embodiment of the vortex fluidistor of FIGS. 15A and 15B.

Figure 17:
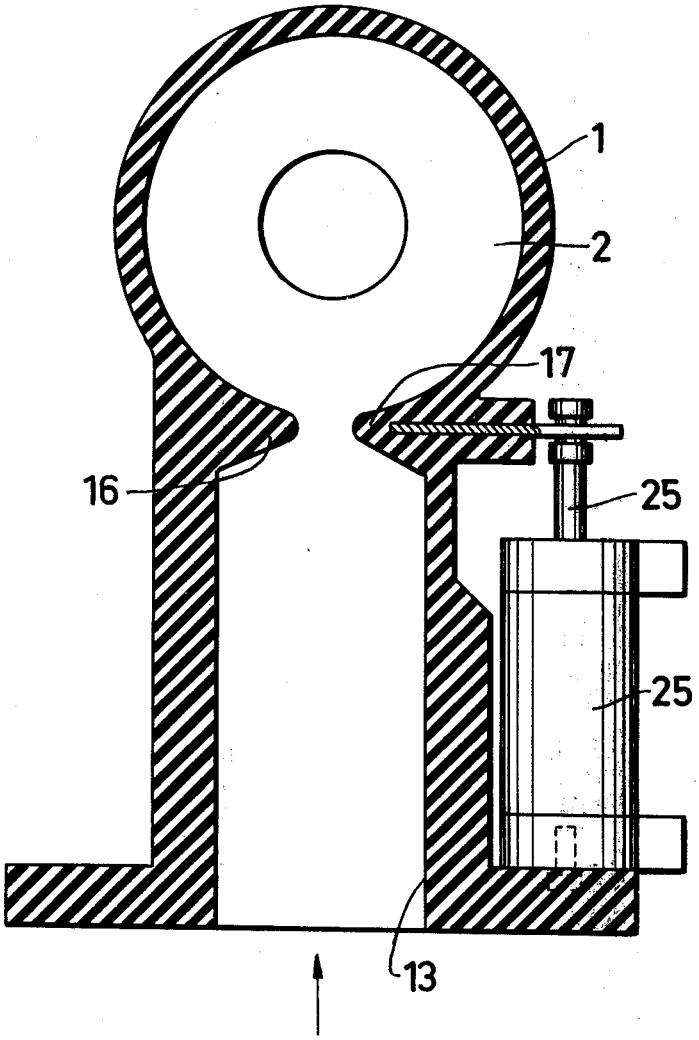

FIG. 17 shows a section of another embodiment of the vortex fluidistor of FIGS. 15A and 15B.

Figure 18A:
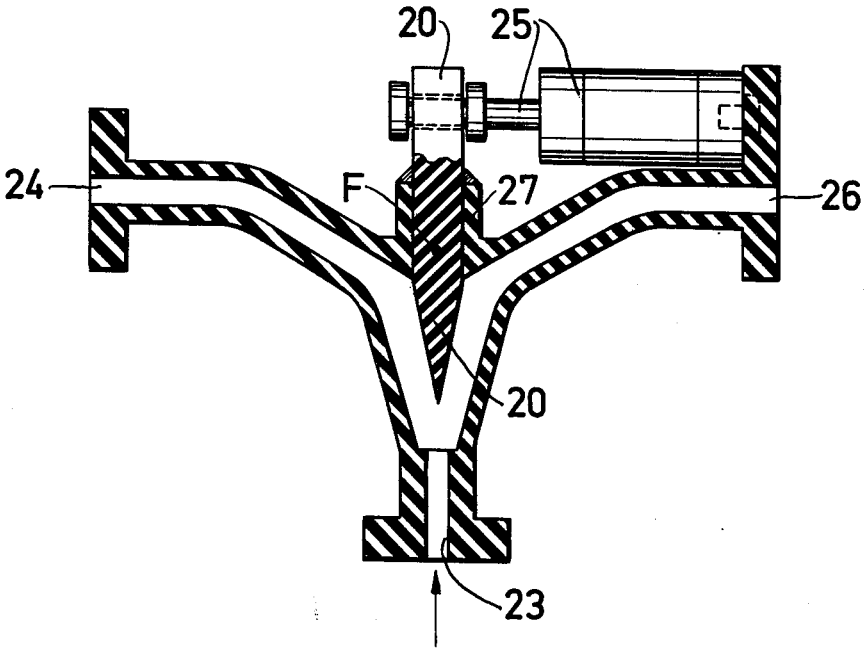

FIG. 18A is a section of a modified fluidistor of the invention.

Figure 18B:
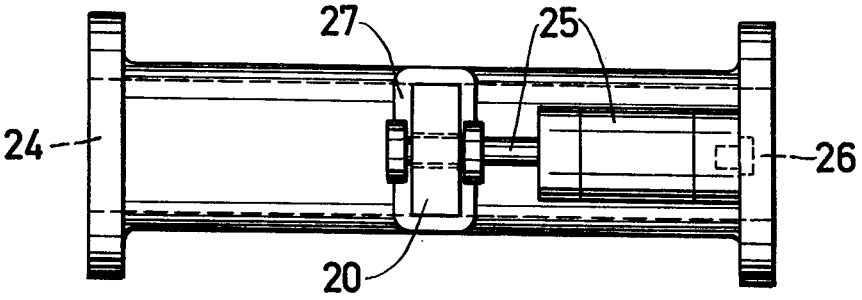

FIG. 18B is a plan view of the device according to FIG. 18A.

Figure 19:
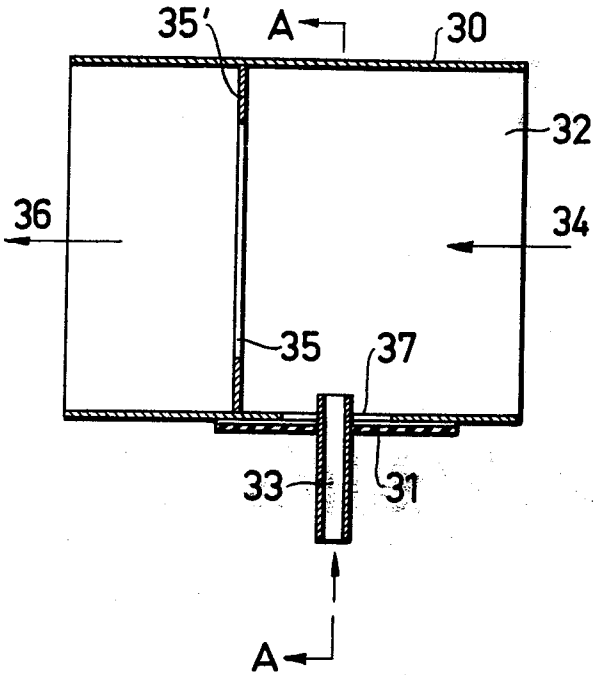

FIG. 19 is a longitudinal section of a vortex fluidistor with a straight through-flow primary passage and a secondary inlet according to the invention.

Figure 21:
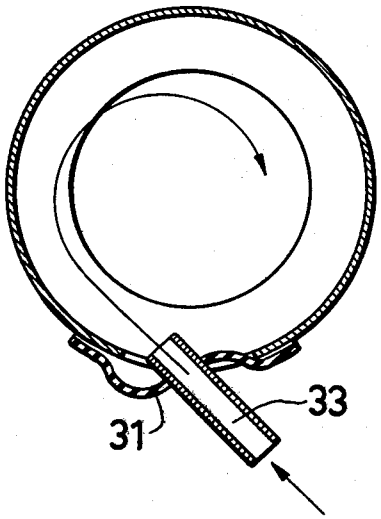
Figure 20:
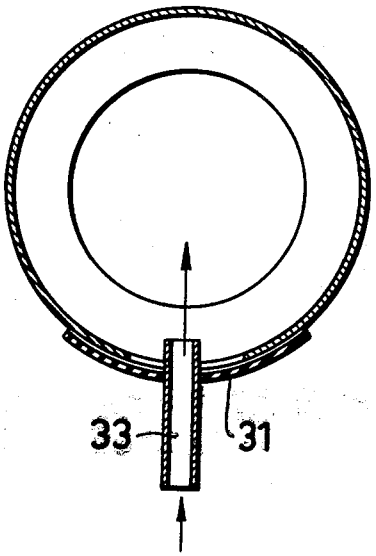

FIGS. 20–21 are views along line A—A of FIG. 19.

Figure 1:
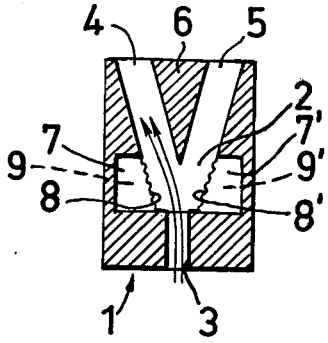
FIGS. 1–3 are longitudinal sections of an embodiment of the invention showing the device in three sequential situations.
Figure 2:
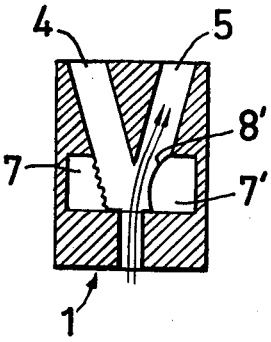
Figure 3:
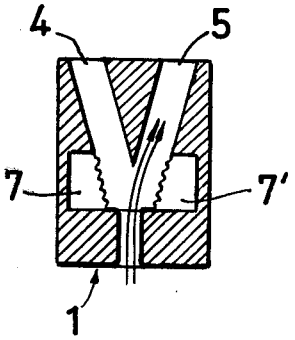

Referring now to the drawings, FIGS. 1–3 show an embodiment of the invention in the form of a flow device such as for the control of a fluid stream, the device comprising a conduit system with a cavity 2 with at least one rigid inlet conduit 3 and at least one outlet 4, 5 for a fluid stream, the conduit system comprising diaphragm means 8, 8' or the like which by external application of a pressure medium by way of chambers 7, 7' are deformable to affect said fluid stream. Adjacent the mouth of the inlet conduit 3 said diaphragm means each forms a wall portion of said cavity 2 which wall portion by means of said pressure can be brought to a convex form inwards in said cavity to actuate by Coanda-effect said fluid stream to change its direction for example to outlet 5 near said diaphragm means 8' (see FIGS. 2–3) from outlet 4 being more remote (see FIG. 1), or vice versa.

In another embodiment (not illustrated) of said fluid device, adjacent the mouth of the inlet conduit said deformable diaphragm means forms a ring-like circumferential wall portion of said cavity which wall portion by means of said pressure can be brought to a convex form inwards in said cavity to actuate by Coanda-effect said fluid stream to change its form and/or direction for example relative to an inwards protruding, the inlet conduit opposing the outlet tube, which tube for example is arranged as a turbulence-fluidistor.

Figure 4:
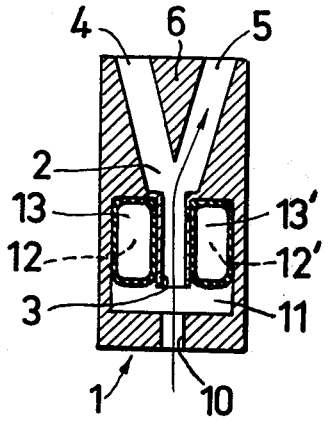
FIGS. 4–6 are longitudinal sections of another embodiment of the invention in three sequential situations.
Figure 5:
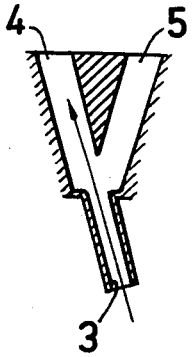
Figure 6:
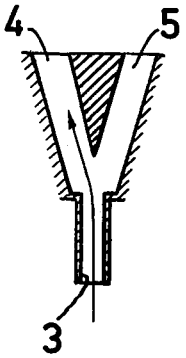
Figure 7:
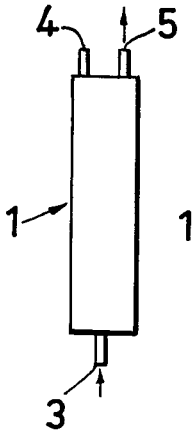
FIGS. 7–11 are a front elevation of another embodiment of the invention showing the device in five sequential situations.
Figure 8:
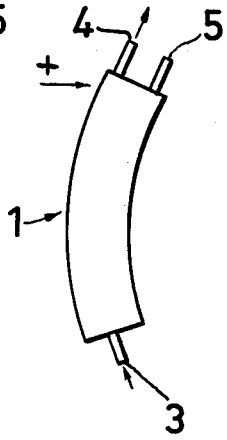
Figure 9:
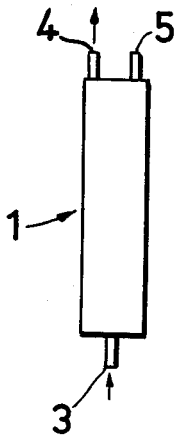
Figure 10:
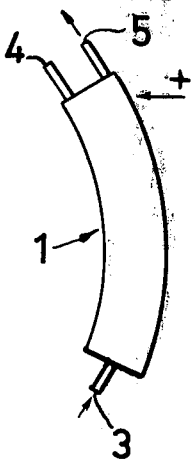
Figure 11:
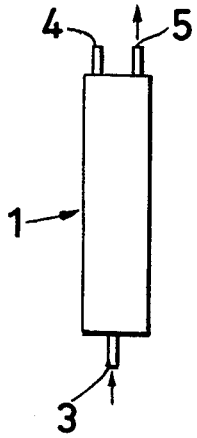
Figure 11B:
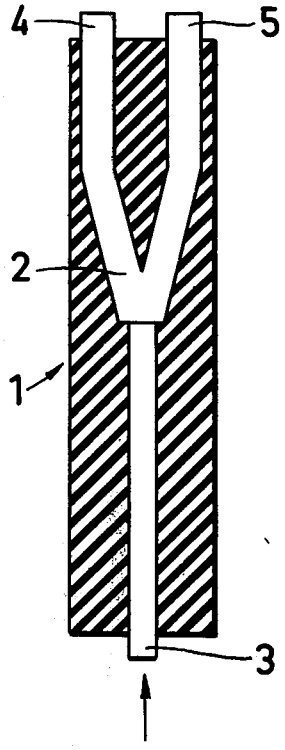
FIG. 11B shows on a larger scale a longitudinal section of the device according to FIGS. 7–11.

FIGS. 4–6 show another embodiment of a flow device in accordance with the invention such as for the control of a fluid stream, the device comprising a conduit system with a cavity 2 with an inlet conduit 3 and two outlets 4, 5 for a fluid stream. The substantially rigid tube forming inlet conduit 3 is connected to a flexible or diaphragm-like portion of said cavity 2, said inlet tube 3 being arranged by means of flexible, pressure medium actuated chambers 12, 12' to be brought to varying angular positions to make the inlet tube 3 coaxial with outlet 5 or outlet 4, respectively. Said fluid stream can be fed to said rigid inlet tube 3 through a flexible means (not shown) as for example a hose, the inlet end of said hose being mainly stationary. At least one pressure medium actuable flexible chamber 13, 13' is arranged for effecting the swing motion of the inlet tube 3 to varying angular positions. FIGS. 7–11B show an embodiment of the invention in the form of flow device such as for the control of a fluid stream, the device comprising a passage system with a cavity 2 with an inlet passage 3 and two outlets 4, 5 for a fluid stream, the passage system being performed in a material block 1 of cylindrical or parallelpipedical form. The material block preferably consists of a flexible or resilient material. The material block is lengthwise flexible so that thereby the inlet passage 3 is capable of being bent relative to the cavity 2 to such degree that the fluid stream entering the cavity 2 from the inlet passage 3 is brought to change its direction for example from one outlet to another of the two outlets 4, 5, or vice versa. The material block 1 preferably is provided with external recesses (not shown) for facilitating the flexibility thereof. Preferably said cavity 2 and said passages 3, 4, 5 have rectangular cross sections.

FIG. 12 is a section of an embodiment of the invention in the form of a flow device such as for the control of a fluid stream, the device comprising an inlet conduit 3 at its inner end having two mutually opposite stream deflectable members in the form of plate means or ribs or wedge means 16, 17 mainly forming a gap for the passage of a fluid stream from the inlet conduit 3, said wedge means being arranged by relative turning or displacement thereof to change the direction of said fluid stream for example to outlet 5 from the other outlet 4, or vice versa.

Figure 14A:
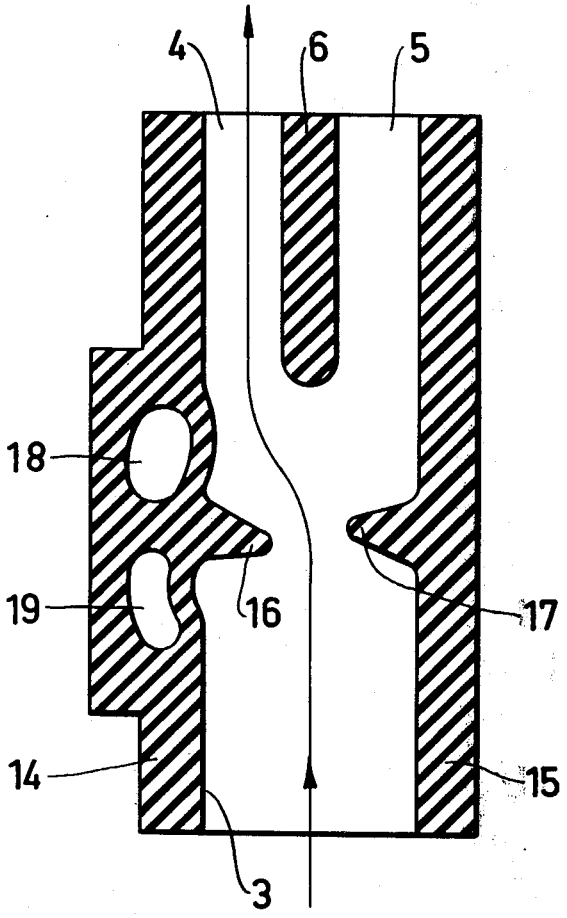
FIG. 14A is a longitudinal section of another embodiment of the device according to FIG. 12.

In another embodiment of the device of FIG. 12 (see FIG. 14A) at least one of the wedge means, 16, is turnable in one direction or the other by means of alternatively expandable chambers, 18, 19, arranged in the flexible wall of the inlet conduit 3 and is operable by the pressure of a fluid medium in these two chambers to displace said wedge means axially of the inlet conduit to change the direction of said fluid stream. In still another embodiment of the device of FIG. 12 (see FIG. 14A) said pressure of said medium is brought about by the thermal expansion of said medium such as by electrically heating thereof (for example by resistance, by induction or by high frequency energy.) According to the invention, such inlet conduit with said thermally controllable wedge means for directing the fluid stream advantageously constitute a mainly radially directed primary or secondary inlet of a vortex fluidistor said directing means being operable to direct said fluid stream mainly tangentially relative to said vortex fluidistor.

Figure 12A:
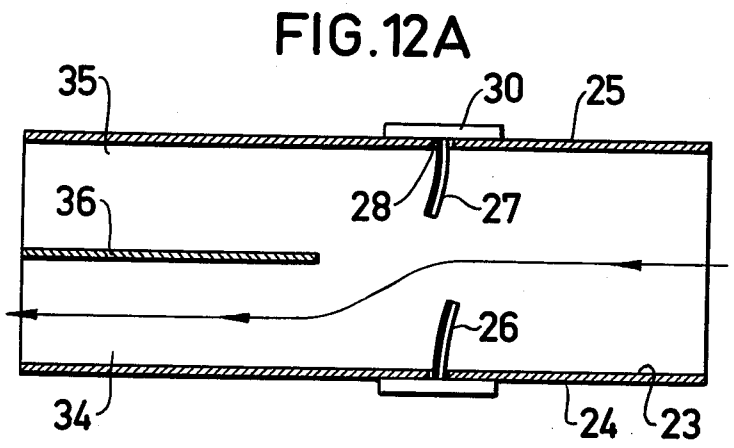
FIGS. 12A–12D are longitudinal sections of another embodiment for example for ventilation purposes.
Figure 12B:
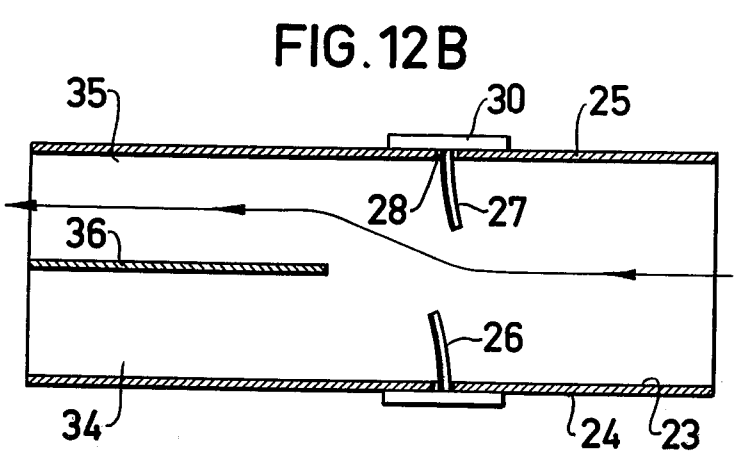
Figure 12C:
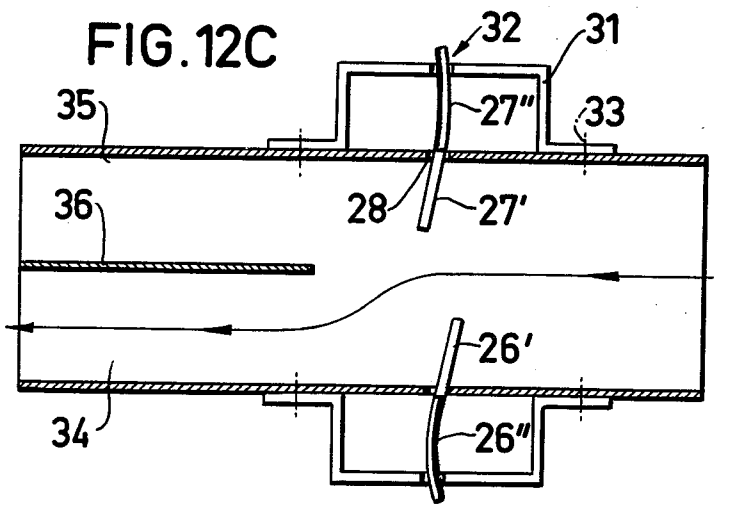
Figure 12D:
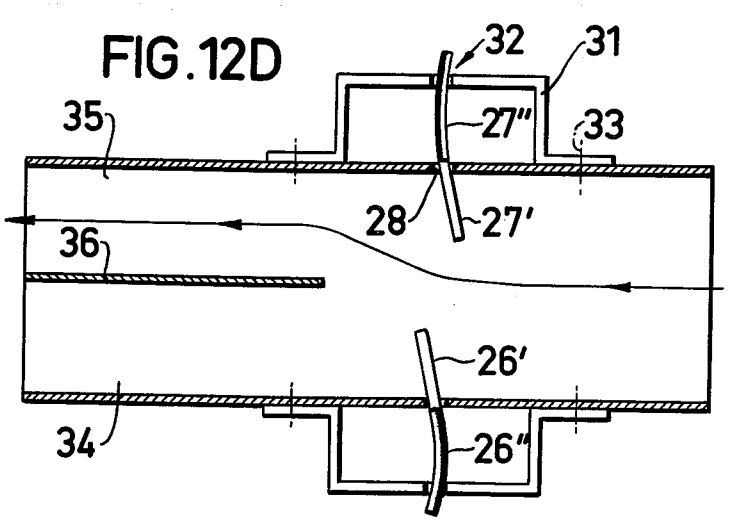

FIGS. 12A–12D show other embodiments of the device of FIG. 12 for the control of a fluid stream such as for ventilation purposes. The figures include conduit means 24, 25 each with an inlet conduit 23 and two outlets 34, 35 separated by a partition wall 36. In slots 28 of the walls of said conduits means plate means, are inserted for the temperature control of the fluid stream in said conduit. In the embodiment of FIGS. 12A–12B, bimetallic plate means 26, 27 are inserted through said slots 28 and direct the flow to one of the outlets 34, 35 dependent on the temperature of the flow through said conduit 23. The bimetallic plates are mounted on plates 30 being attached to the outside of said conduit. In the embodiment of FIGS. 12C–12D, bimetallic plate means 26", 27" are mounted outside of said conduit by clamps 31 attached on the outside of said conduit by screw means 33. Said bimetallic means are connected to plate means 26', 27' inside of said conduit and actuate said plate means dependent on the temperature outside of said conduit. According to the invention, such inlet conduit with said temperature actuated plate means for directing the fluid stream advantageously constitute a mainly radially directed primary or secondary inlet of a vortex fluidistor said directing means being operable to direct said fluid stream mainly tangentially relative to said vortex fluidistor. In still another embodiment of the device of FIG. 12 (see FIG. 14B, FIG. 17) at least one of said plate or wedge means, 17, extends through said inlet conduit wall and in a manner corresponding to said turning thereof is operable from the outside for example by a cylinder-piston-device 25 being actuated by a pressure medium.

FIGS. 15A–15B diagrammatically show a vortex fluidistor 1, 2 with an inlet conduit 13 arranged mainly as the device of FIG. 12. The wedge means 16, 17 forms a directing device for the entering fluid stream, the inlet conduit 13 constituting a mainly radially directed primary inlet for the vortex fluidistor being operable to direct the fluid stream from said primary inlet approximately tangentially relative to the vortex fluidistor. According to the invention the inlet conduit 13 is capable of constituting a mainly radially directed secondary inlet for a vortex fluidistor said secondary inlet as well being operable to direct a fluid stream approximately tangentially relative to the vortex fluidistor.

Figure 13:
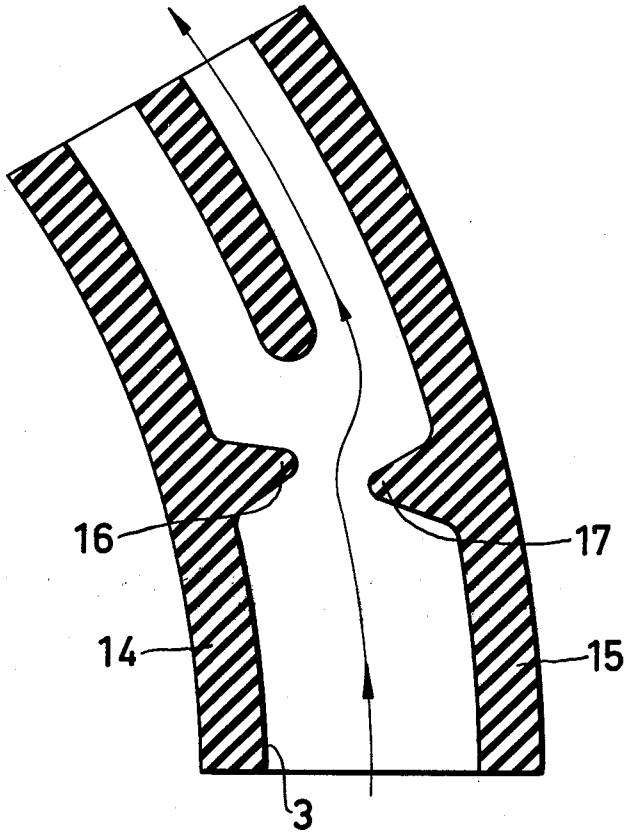
FIG. 12 and FIG. 13 are longitudinal sections of another embodiment of the invention in two sequential situations.

FIGS. 16A–16B show a vortex fluidistor according to FIGS. 15A–15B in combination with an inlet conduit 13 with wedge means 16, 17 being operable in accordance with the device of said FIGS. 12–13.

Figure 14B:
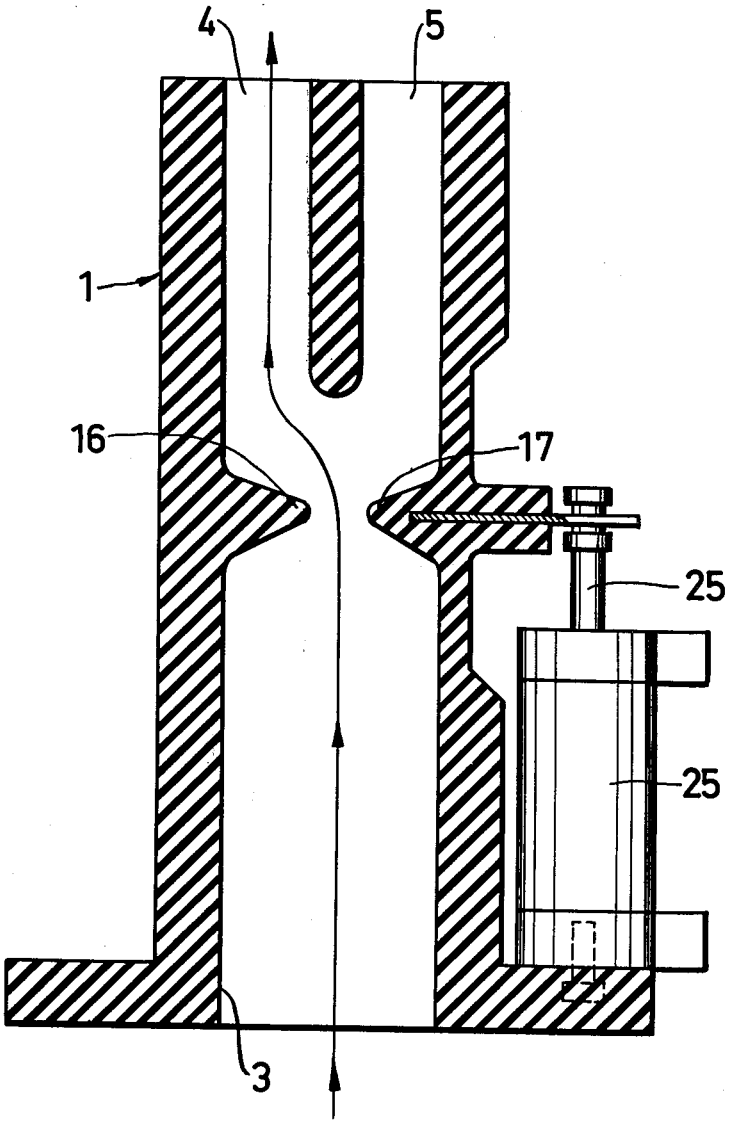
FIG. 14B is a longitudinal section of still another embodiment of the device according to FIG. 12.

FIG. 17 shows a vortex fluidistor according to FIGS. 15A–15B in combination with an inlet conduit 13 with wedge means 16, 17 being operable in accordance with the device of said FIG. 14B.

In the flow device according to FIG. 14B and FIG. 17 one of said wedge means 16, 17 advantageously is made separately as shown in FIG. 14C and is inserted through the wall of the device, for example through a flexible or resilient socket extending outwards from the wall of the device said wedge means for example being connected by welding or curing at 38 to the outer end of said socket 37.

FIGS. 18A–18B show another embodiment of the invention, in the form of a flow device such as for the flow control of a fluid stream, the device comprising a cavity 22 with one inlet passage 23 and two outlet passages 24, 26 for a fluid stream. Said cavity comprises a single movable plate or wedge means 20 arranged between the outlets and opposing the inlet passage 23 and being turnable about a fulcrum F near its end opposing said inlet passage 23 being turnable to varying positions such as to bring the fluid stream entering through the inlet passage 23 to change its direction from one of the outlets to the other. Said turnable wedge means 20 extends through a wall of said device opposing said inlet passage 23, said wedge means being turnable from outside for example by a cylinder-piston-device 25 operable by a pressure medium. The end of said wedge means 20 nearest to the inlet passage 23 is arranged in its swing motion to either side wall of the cavity 2 to engage a bladder at said side wall, said bladder being produced near the mouth of the inlet passage 23 in said cavity through Coanda-effect in a manner known from the field of fluidistors.

In the flow device according to FIG. 18 the material of the end faces of the wedge means 20 advantageously is flexible or resilient and is connected to the adjacent wall surfaces of the cavity 22. Instead thereof the end faces of said wedge means 20 advantageously are separated from the adjacent wall surfaces of the cavity through a small clearance, preferably comprising sealing means (not shown) between the end faces of said wedge means 20 and the adjacent wall faces of said cavity.

In the device according to FIG. 18 the outlets form passages 24, 26, which passages advantageously at least adjacent said wedge means 20 form an angle not exceeding 150°.

In the flow device according to FIG. 18 said wedge means 20 advantageously is made separately and is inserted through a flexible or resilient socket 27 extending outwards from the wall of said device, said wedge means for example being connected by welding or curing to the outer end of said socket.

In the flow device according to FIG. 18 said wedge means 20 advantageously is arranged so as to be turnable about a fulcrum without a fulcrum pin or the like.

FIGS. 19, 20, 21 illustrate another embodiment of the invention, diagrammatically showing a flow device such as for the control of fluid streams and particularly for controlled mixing of for example fluid streams entering through primary and secondary inlets and having different temperatures or different physical or chemical compositions. The device comprises a vortex fluidistor 30 with a primary inlet 34 with a mainly straight primary through-flow passage 32 to an outlet 36 and a restriction plate 35' with an opening 35. The device also includes a secondary inlet 35 comprising a substantially rigid tube 33 connected to and passing through a flexible or membrane-like portion 31 of the wall of said primary through-flow passage 32 said tube 33 being arranged to be brought to varying angular positions between about radial and about tangential positions relative to said primary through-flow passage. The inlet tube 33 is turnable in a plane perpendicular to the axis of said through-flow passage. According to FIG. 20 the inlet tube 33 is radially directed and is according to FIG. 21 directed for example about 45° from the radial direction. Therefore, with the secondary inlet 33 directed according to FIG. 20 the primary flow entering through the primary inlet 34 can pass mainly unobstructed straight forward through the opening 35. With the secondary inlet directed according to FIG. 21, however, the primary flow is brought to a powerful rotary motion obstructing the passage of said primary flow through the opening 35 and restricting said primary flow. Therefore, controlling the angle between the secondary inlet 33 and said radius makes possible the control of the primary flow as well as the control of the mixing of the primary flow through inlet 34 with the secondary flow through inlet 33. The fluid stream preferably is fed to said rigid inlet tube through a flexible means such as a hose (not shown) the inlet end of said hose being substantially stationary. Said inlet tube 33 preferably has a substantially rectangular cross section.

Advantageously the devices according to the invention partially or entirely consists of rubber or another resilient and/or flexible or wear resistant or corrosion resistant material.

Advantageously the devices according to the invention e.g. FIG. 14C comprise a shoulder face 16', 17' adjacent the mouth of the inlet passage 3, 13, 23, in the cavity 2 so that by Coanda-effect a fluid stream entering through said inlet passage will be retained at a side wall of said cavity 2 in a manner known from the field of the fluidistors.

As well as for the control of fluid streams and the like the devices according to the invention advantageously are arranged for the measurement or the sensing of for example flow rate, pressure, and temperature of a fluid stream.

Advantageously the devices according to the invention can be arranged with the application thereon of modifications which are known or obvious for example from the fluidistor field and which make said flow device capable of measuring or sensing of, for example, flow rate, pressure, and temperature of a fluid stream.

What is claimed is:

1. A flow device for a fluid stream to control the direction of said stream, said device comprising a conduit having an inlet for the fluid and at least one outlet for the fluid, said inlet and the or each outlet being separated from each other within said conduit by a gap coaxial with the axis of the conduit and defined by opposed offsettable inner edges of two mutually opposite flexibly mounted stream-deflecting members extending inwardly of said conduit in a direction transverse to the axis of said conduit; the arrangement being such that at least one of the stream-deflecting members is movable relative to the other by flexing that member in a direction parallel to the axis of said conduit whereby said inner edge of said one member is brought out of opposition with respect to the inner edge of the other member thereby to effect a corresponding change in the direction of the axis of said gap and consequently a corresponding change in the direction of the stream as it flows through said gap towards the outlet end of the conduit.

2. A flow device as claimed in claim 1, wherein said conduit is provided with two outlets and wherein the movement imparted to the stream-deflecting member serves to shift the stream flowing through said gap from one of said outlets to the other depending upon the direction in which said deflecting member is moved.

3. A flow device as claimed in claim 1 wherein movement of one of said stream-deflecting members relative to the other is effected by means of an actuating member therefor extending through a flexible wall portion of said conduit and which is connected to actuating means movable longitudinally of the axis of said conduit in one direction or the other.

4. A fluid flow control device as defined in claim 1 wherein said conduit is made of a flexible material and wherein the movement imparted to one of the stream-deflecting members relative to the other is effected by bending said conduit longitudinally.

5. A fluid flow control device as defined in claim 1 wherein said means for imparting a movement to one of said stream-deflecting members relative to the other is constituted by a pair of selectively expandable chambers incorporated in a flexible wall portion of said conduit at opposite sides of said stream-deflecting member and which are selectively expanded by introduction of a pressurized fluid medium.

6. A fluid flow control device as defined in claim 1 wherein said means for imparting a movement to one of said stream-deflecting members relative to the other is constituted by a temperature responsive bimetallic member connected therewith.

7. A fluid control device as defined in claim 6 wherein said bimetallic member is located interiorly of said conduit.

8. A fluid flow control device as defined in claim 6 wherein said bimetallic member is located exteriorly of said conduit.

* * * * *